US008932439B2

(12) United States Patent
Suk

(10) Patent No.: US 8,932,439 B2
(45) Date of Patent: Jan. 13, 2015

(54) ELECTROLYTIC BOTH FOR RECOVERING VALUABLE METALS, WITH INCREASED CONTACT SPECIFIC SURFACE AREA

(76) Inventor: Sangyoup Suk, Seoul (KR)

( * ) Notice: Subject to any disclaimer, the term of this patent is extended or adjusted under 35 U.S.C. 154(b) by 388 days.

(21) Appl. No.: 13/395,885

(22) PCT Filed: Sep. 14, 2009

(86) PCT No.: PCT/KR2009/005212

§ 371 (c)(1),
(2), (4) Date: Mar. 13, 2012

(87) PCT Pub. No.: WO2011/030945

PCT Pub. Date: Mar. 17, 2011

(65) Prior Publication Data

US 2012/0181183 A1 Jul. 19, 2012

(51) Int. Cl.

| | |
|---|---|
| ***C25B 9/00*** | (2006.01) |
| ***C25D 21/18*** | (2006.01) |
| ***C02F 1/461*** | (2006.01) |
| ***C25C 1/00*** | (2006.01) |
| ***C25D 17/12*** | (2006.01) |

(Continued)

(52) U.S. Cl.

CPC . *C25D 21/18* (2013.01); *C25C 1/00* (2013.01); *C25C 7/00* (2013.01); *C25D 17/12* (2013.01); *C25D 17/008* (2013.01)

USPC ..... 204/272; 205/758; 205/771

(58) Field of Classification Search

CPC ..... C02F 2001/461104; C02F 2101/20; C02F 2201/003; C02F 2209/05; C02F 2001/46104; C02F 1/46104; C25C 7/00; C25C 7/25; C25D 17/12; C25D 21/18

USPC ..... 204/272, 284; 205/742, 758, 771

See application file for complete search history.

(56) References Cited

U.S. PATENT DOCUMENTS

| | | | | |
|---|---|---|---|---|
| 4,226,695 | A * | 10/1980 | Matson | 204/230.1 |
| 4,693,797 | A * | 9/1987 | deNora | 205/525 |
| 5,948,220 | A * | 9/1999 | Kamitani et al. | 204/228.2 |

(Continued)

FOREIGN PATENT DOCUMENTS

| | | |
|---|---|---|
| JP | 58126996 | 7/1983 |
| JP | 05208190 | 8/1993 |

(Continued)

*Primary Examiner* — Keith Hendricks
*Assistant Examiner* — Steven A. Friday
(74) *Attorney, Agent, or Firm* — Robert D. Atkins; Patent Law Group: Atkins and Associates, P.C.

(57) ABSTRACT

The present invention includes an electrolytic bath with increased contact specific surface area configured to effectively electrodeposit valuable metals from waste water, wherein the specific surface area of an electrode contacting the waste water is maximized to increase electrolysis efficiency, and electrolysis space is increased to enable effective electrodeposition and recovery of valuable metals from low-concentration waste water. The electrolytic bath comprises: a housing having an inlet, outlet, gas discharge hole, and inner space; an anode group comprising a plurality of anodes installed in the inner space; a cathode group installed between the anodes to form two electrolysis spaces, and cathode wire threads placed on one side of each electrolysis spaces. As waste water flows through the inlet and electrolysis spaces and then is discharged through the outlet, metal is electrodeposited onto the cathode group and gas is discharged through the gas discharge hole.

16 Claims, 5 Drawing Sheets

(51) Int. Cl.
*C25C 7/00* (2006.01)
*C25D 17/00* (2006.01)

(56) References Cited

U.S. PATENT DOCUMENTS

| | | | | |
|---|---|---|---|---|
| 6,706,168 | B2 * | 3/2004 | Igarashi | 205/744 |
| 2004/0226826 | A1 | 11/2004 | Cheng et al. | |
| 2005/0189236 | A1 * | 9/2005 | Polnicki et al. | 205/742 |
| 2009/0145774 | A1 * | 6/2009 | Farooq et al. | 205/742 |

FOREIGN PATENT DOCUMENTS

| | | |
|---|---|---|
| JP | 07300692 | 11/1995 |
| JP | 09225470 | 9/1997 |
| JP | 10195697 | 7/1998 |
| JP | 2006028555 | 2/2006 |
| KR | 100325677 | 2/2002 |
| KR | 100874684 | 12/2008 |

* cited by examiner

ELECTROLYTIC BOTH FOR RECOVERING VALUABLE METALS, WITH INCREASED CONTACT SPECIFIC SURFACE AREA

CLAIM TO FOREIGN PRIORITY

The present application is a U.S. National Stage Application filed under 35 U.S.C. 371 claiming priority from International Application No. PCT/KR2009/005212, filed Sep. 14, 2009.

FIELD OF THE INVENTION

The present invention relates to an electrolytic bath for electrodepositing and efficiently recovering recyclable valuable metals from plating waste water or waste water containing valuable metals, and more particularly, to an electrolytic bath for recovering valuable metals, which has more contact specific surface area of an electrode with which waste water contact is maximized to improve electrolysis efficiency and increase electrolysis space so that valuable metals are electrodeposited and recovered efficiently from waste water containing lower concentration of valuable metals.

BACKGROUND OF THE INVENTION

Generally, it has been practically important in view of the increase in value of waste resources and of avoiding environment contamination that valuable metals are recycled from scraps from electronic device such as a print circuit board used for various electronic products, or from waste catalyst that comes mainly from a chemical factory. Further, because of the amount of heavy metals contained in waste water from a plating factory or clothing factory, etc., or waste water produced when developing photographs, it is important in view of the increase in value of waste resource and of avoiding environment contamination that the waste water is recycled and the valuable metals are recovered efficiently.

As for a method for treating waste water containing Pt, Rh, Au, Ag, Cu, etc., and recovering them, it has been proposed that the waste resource is crushed and then leached with a solvent of acid or alkali, etc., and valuable metals are obtained using a chemical precipitation method or electrolysis method. The electrolysis method is used partly not only when recovering the valuable metals or heavy metals contained in waste water but also when treating or producing general inorganic compounds or organic compounds. However, there are drawbacks in that treatment time is long and efficiency is low using existing electrolytic equipment and further it occupies a large space.

The existing electrolytic equipment for electrolysis resultant product within waste water and obtaining final product is configured generally such that anodes and cathodes of a parallel plate type are arranged alternatively within an electrolytic bath. Under this type of an electrolytic bath, material is moved through only diffusion and thus the solution is compulsively convective through stirring or gas injection to increase material movement velocity. However, there is a limitation electrolysis condition of a high current density. This electrolytic bath may be configured as a rectangular shape or column shape depending on necessity thereof.

Referring to a waste water treatment method used in a current plating industry, the waste water is mainly slugged with a chemical agent and buried in the ground. Valuable metal components within the waste water and industrial water are not recycled but are discharged outside, causing serious environmental contamination and incurring the cost of treating them with the chemical agent.

FIG. 1 shows electrolytic bath 100 according to one embodiment of a prior art for electrically depositing and recovering valuable metals from plating waste water or waste water containing valuable metals, wherein cylindrical internal electrode plate 130 and cylindrical external electrode plate 120 are arranged inside cylindrical housing 110 within which internal cavity 113 is formed. Inlet 112 and outlet 111 through which waste water is inputted and discharged are formed in housing 110.

Through the above configuration, electric power is supplied from an external power source (not shown) to internal electrode 130 and external electrode 120 and then current is applied thereto. At this time, the polarities of internal electrode 130 and external electrode 120 may be arranged arbitrarily wherein one assumes the negative and the other assumes the positive.

From the above polarities of the electrodes, electrons are supplied to the cathode from the power source and cations in the waste water (solution) within the electrolytic bath are diffused to a surface of the cathode wherein an electrochemical reaction occurs, that is, the cations receive electrons and are reduced to deposit valuable metals on the cathode and recover them.

However, according to prior electrolytic bath 100 having one cathode and one anode, since the specific surface area of the cathode is not large, the contact area between the waste water in the electrolytic bath and the cathode is small, and the contact time is short, causing the valuable metals to not be recovered efficiently. In addition, referring to a low concentration of the waste water, that is, the waste water contains valuable metals of 10 ppm or less, since the contact specific surface area is very small, depositing and recovering the valuable metal is difficult, causing the efficiency of deposition and recovering to be low.

In other words, since the reduction process occurs on a surface of a simple cathode, there arise problems in that reaction speed is limited and thus several electrolytic baths 100 are necessary for achieving mass production, and further that electrolysis efficiency decreases significantly as time passes.

Meanwhile, generally titanium (Ti) is used for the electrode plate material because Ti has the advantage of not being dissolved in the aqua regia used for recovering the valuable metals. However, Ti has low electric conductivity and thus other metal having high electric conductivity or a combination thereof is plated to a surface of the Ti electrode plate.

Additionally, an electrode plate of a dish sponge configuration which increases the specific surface area on which the valuable metals are electrically deposited and recovered has been used as the cathode, however, the cathode of the dish sponge configuration is fabricated such that a shape thereof is fabricated with a polymer compound (plastic) and then the surface thereof is coated with a metal having high electric conductivity such as copper (Cu) in order to increase electric conductivity, causing fabrication of a cathode of the dish sponge configuration to be difficult.

In addition, when the electrodes surfaces are coated with high electric conductivity metals, the coating metals are dissolved by additions (citric acid, cleaning agent, etc.) which are inputted during the electrolysis process in order to recover the valuable metals and then are extracted as impurities, causing overall electrolysis efficiency to be lowered.

Furthermore, the waste water which is inputted into the electrolytic bath 100 assumes a neutrality, acidity or alkalinity property depending on their characteristic properties and the metals plated on the surface of the electrode are dissolved depending on the pH of the waste water inputted into the electrolytic bath 100, causing the electrolysis efficiency to be lowered. As a result, these electrodes are not able to be recycled after recovering the valuable metals one time and thus have to be replaced. Accordingly, there is a need for an electrolytic bath in which the specific surface area in contact with the waste water is enlarged and through which electrolysis efficiency for recovering the valuable metals is increased.

SUMMARY OF THE INVENTION

In order to achieve the object of the present invention, an electrolytic bath for depositing electrically and recovering valuable metals according to the present invention comprises: a housing having an internal space, on one side of which an inlet is formed and on the other side of which an outlet and gas discharge hole are formed; a anode group consisting of a plurality of anodes arranged to surround the inside of the housing; and a cathode group surrounding the inside of the housing, which is arranged between the anodes and divides a space adjoining the anodes into two electrolysis spaces in which a quantity of cathode wire thread is placed on one side of the respective electrolysis space and the specific surface area in contact with the waste water is increased. Here, the waste water inputted through the inlet passes through in sequence the plural electrolysis spaces and valuable metals are deposited electrically and recovered on the cathode group including a quantity of cathode wire thread and gas is discharged through the gas discharge hole and is discharged outside through the outlet.

According to one embodiment of the present invention, the housing is a cylinder shape having an internal space.

In addition, the cathode group comprises: a middle cathode which divides the space between adjoining anodes into two parts, surrounds the internal space of the housing, is shaped as a cylinder, and has a plate configuration; a first cathode which is placed inside and spaced from the middle cathode, is shaped as a cylinder, and has a network configuration; and a second cathode which is placed outside and spaced from the middle cathode, is shaped as a cylinder and has a network configuration. A quantity of cathode wire thread fills the space between the first cathode and middle cathode and the space between the second cathode and middle cathode.

A cathode of the cathode group and an anode the anode group are made of unplated titanium material.

Furthermore, the cathode wire thread has a coil spring shape and a plurality of the cathode wire threads are arranged closely.

Additionally, the cathode wire thread is clustered to an adjoining one to form a dish sponge shape.

Preferably the lower end of the cathode group is seated in the bottom surface of the housing, and waste water flows over the upper part of the middle cathode and is transferred to an adjoining electrolysis space.

Furthermore, the anode group comprises an internal anode which is formed as a cylinder shape of a network configuration and is placed on the middle part of internal space of the housing, and an external anode which is formed as a cylinder shape of a plate configuration, is placed in a space from the inner side wall of the housing, and forms a waste water output path communicated to the outlet. The internal anode is seated and fixed to the bottom surface of the housing and the external anode is fixed to the upper surface of the housing to form a waste water output path downward distance.

Preferably the housing has an inlet formed through the bottom surface thereof, an outlet on the upper part of a side wall, and a gas discharge hole on the upper surface thereof. The internal anode and middle cathode form a first electrolysis space and the external anode and middle electrode form a second electrolysis space which is connected to the first electrolysis space through an 'S' shaped flow path, wherein the waste water inputted through the inlet passes through the first electrolysis space and second electrolysis space in a sequence and is discharged through the outlet.

Additionally, if necessary, the housing further comprises a fluid avoidance ball which is configured to block the gas discharge hole depending on the internal pressure so that gas moves freely and waste water being leaked is avoided.

Furthermore, the housing comprises a cylindrical external body the upper part and lower part of which are open and on an upper side of which a plurality of outlets are formed, a lower cap which is connected to the lower part of the external body to form a bottom surface of the housing and on the middle of which the inlet is formed, and an upper cap which is connected to the upper part of the external body to form an upper surface of the housing and on one side of which the gas discharge hole is formed.

The lower cap may further comprise an input path communicated to the inlet, and a plurality of input path ports which are communicated to the input path and inputs the waste water into the first electrolysis space formed between the internal anode and middle cathode.

Furthermore, the lower cap comprises a flow guide bar which protrudes upward and is placed on the internal part of the internal electrode.

The inlet is connected to an external input tube path through which the waste water is transferred from an external place, and an external pump is provided on one side of the external input tube path for compulsively inputting the waste water into the housing.

Additionally, an addition input tube path for compulsively inputting a current density addition to increase electric conductivity is provided on one side of the external input tube path. The addition input tube path is controlled by a control valve.

The housing further comprises a fluid avoidance ball which is configured to stop up the gas discharging port depending on a pressure of the internal space of the housing so that gas is moved freely and leakage of waste water is avoided, and the upper cap further comprises a avoidance ball fence network having a network configuration, which supports the fluid avoidance ball and controls the free movement of the ball within the internal space of the housing.

DETAILED DESCRIPTION OF THE DRAWINGS

The preferred embodiments of an electrolytic bath for recovering valuable metals in which the contact specific surface area is increased according to the present invention will be described in detail referring to the accompanied drawings.

Figure 1:
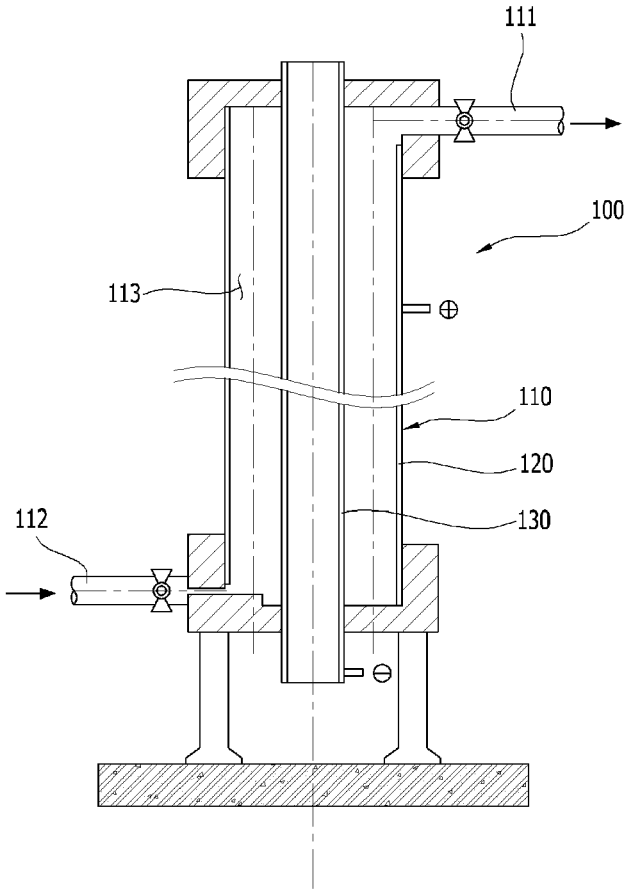
FIG. 1 (PRIOR ART)
FIG. 1 shows schematically an electrolytic bath for recovering valuable metals according to a prior art.
Figure 2:
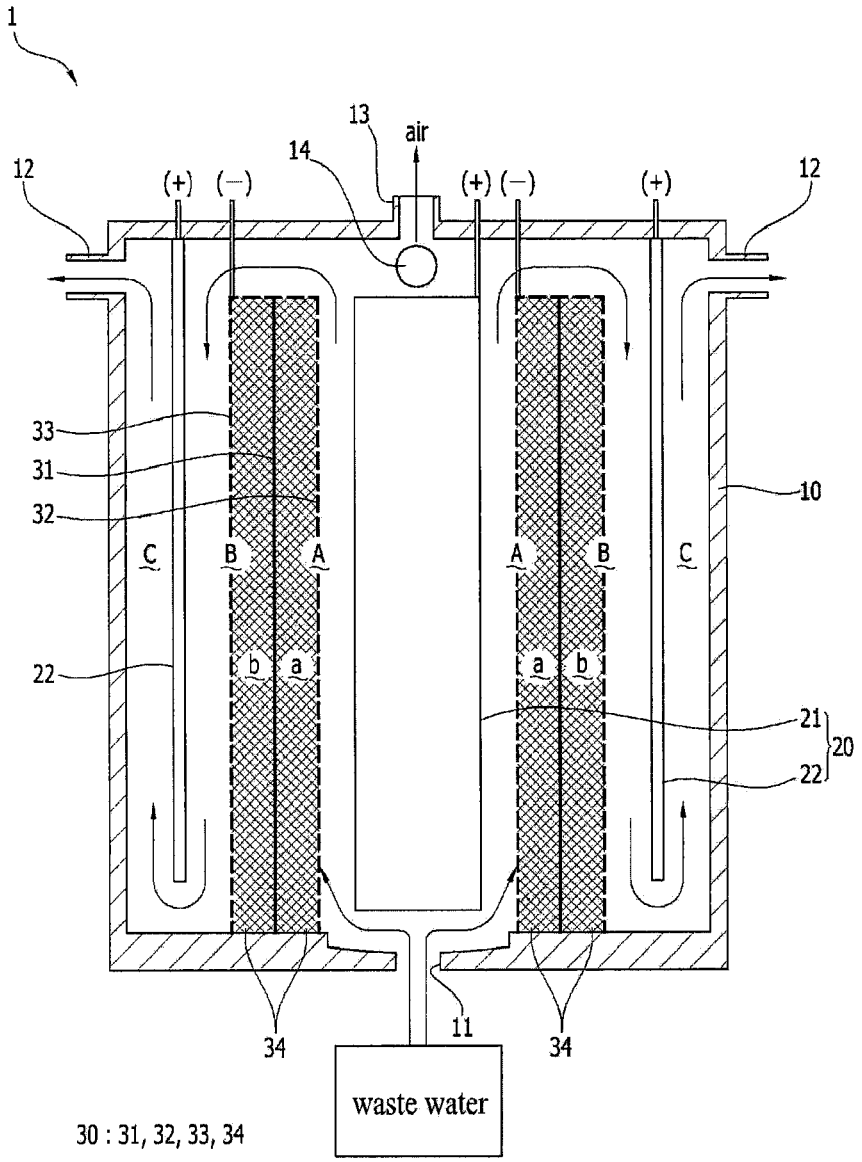
FIG. 2 shows schematically an electrolytic bath for recovering valuable metals in which the contact specific surface area is increased according to the present invention.

FIG. 2 shows schematically an electrolytic bath for recovering valuable metals in which the contact specific surface area is increased according to the present invention.

As shown in FIG. 2, an electrolytic bath 1 for recovering valuable metals in which the contact specific surface area is increased according to the present invention is characterized in that the specific surface area of an electrode with which the waste water inputted into the electrolytic bath 1 is contacted is maximized to increase electrolysis efficiency so that recyclable valuable metals from plating waste water or from other waste water containing valuable metals are electrically deposited and recovered efficiently, and the space in which electrolysis process is performed is increased so that even if the waste water contains minute amounts of valuable metals, the valuable metals are electrically deposited and recovered efficiently.

For the aforementioned purpose, electrolytic bath 1 for recovering valuable metals according to the present invention has a cathode and anode, and electrically deposits valuable metals using electrolysis. The electrolytic bath comprises anode group 20 in which a plurality of anodes are arranged in a space, cathode group 30 which is placed between the above spaces, forms an electrolysis space together with the anode, and on which valuable metals are electrically deposited upon electric power being supplied, and housing 10 having an internal space into which anode group 20 and cathode group 30 can be arranged.

Cathode group 30 divides the space between the anodes into a plurality of electrolysis spaces wherein a quantity of wire thread is filled in one side of the electrolysis space to increase specific surface area contacted with waste water. Preferably, two cathodes 32 and 33 each have a network structure, and plate cathode 31 is placed between cathodes 32 and 33. A quantity of cathode wire thread 34 is placed in spaces a and b formed between plate cathode 31 and the two cathodes 32 and 33 having network structures, causing the contact specific surface area to be increased.

Cathode wire thread 34 is configured as a coil spring shape and disposed to completely fill spaces a and b, or is combined with nearby cathode wire thread to form a dish sponge configuration.

Configuring the cathode wire thread 34 in the above way maximizes the specific surface area of cathode group 30 which increases the amount of valuable metals electrically deposited from within the waste water, causing electrolysis efficiency, that is, valuable metals recovery efficiency to be increased.

Electrolytic bath 1 having the above configuration for recovering valuable metals according to the present invention will be described again referring to FIG. 2 as follows.

Electrolytic bath 1 for recovering valuable metals through an electrical deposition thereon comprises housing 10, anode group 20 and cathode group 30 within housing 10. Housing 10 has inlet 11 on one side thereof through which waste water is inputted, outlet 12 on the other side, and an internal space on which gas discharging port 13 is formed and which provides a space within which the waste water is electrolyzed. Preferably, inlet 11 is configured to pass through the bottom surface of housing 10, outlet 12 is formed on an upper part of the side wall of housing 10 and gas discharging port 13 is formed on the upper surface of housing 10.

Anode group 20 is formed in an internal space of housing 10 and comprises a plurality of anodes 21 and 22 surrounding the internal space. Preferably, anodes 21 and 22 are configured such that the upper part and lower part thereof are opened and they are shaped as a cylinder or rectangular drum depending on the shape of housing 10.

Furthermore, cathode group 30 is arranged in an internal space of housing 10, and preferably it surrounds the internal space and further is formed as the same shape as the anode. Additionally, cathode group 30 is arranged between the plurality of anodes and divides the space adjoining anodes 21 and 22 into two electrolysis spaces A and B wherein a quantity of cathode wire thread 34 is arranged in spaces a and b on one side of the respective electrolysis spaces, causing the specific surface area contacting the waste water to be increased.

Under this configuration of electrolytic bath 1 for recovering valuable metals according to the present invention, the waste water inputted through an inlet of housing 10 passes through in sequence the plurality of electrolysis spaces A and B and the valuable metals contained in the waste water are electrically deposited and recovered on cathode group 30 comprising a quantity of cathode wire thread 34, and then the gas produced during the depositing process, that is, during the electrolysis process within the electrolysis space is discharged through gas discharge hole 13 of housing 10.

Gas discharge hole 13 is designed so that the gas, rather than being passed through the internal space of housing 10 and being filled therein, is discharged first when the waste water passes through the electrolysis spaces A and B depending on the electrolysis process performed within housing 10, and thus the gas discharge hole is essentially necessary for avoiding damage to electrolytic bath 1 and safety risks.

Housing 10 further comprises fluid avoidance ball 14 which stops up the gas discharge hole 13 depending on a pressure of the internal space of the housing 10 so that gas is moved freely and leakage of waste water is avoided. In addition, if necessary, gas discharge hole 13 and outlet 12 may be formed as plural and a part of the produced gas may be discharged through outlet 12, together with the waste water.

Anode group 20 and cathode group 30, as known, are generally connected to an external power source (not shown) by an electrode tip protruding to an external part of housing 10 and the supplied power source and then assume the roles of anode and cathodes, respectively. Preferably, the housing from which the electrode tip protrudes may be configured so that the waste water is not leaked outside.

Meanwhile, unplated Ti material is used for the electrodes of anode group 20 and cathode group 30 applied to the electrolytic bath for recovering valuable metals according to the present invention. Ti is beneficial because it allows the valuable metals to be obtained at a high purity in a subsequent process using aqua regia without producing impurity.

Of course, if necessary, Ti material may be used for surfaces of anode group 20 and cathode group 30, plated with metal having high electrical conductivity, depending on characteristic property inputted into electrolytic bath 1 for recovering valuable metals.

Subsequently, electrolytic bath 1 for recovering valuable metals in which the contact specific surface area is increased will be described referring to FIGS. 3-5 as follows.

Figure 3:
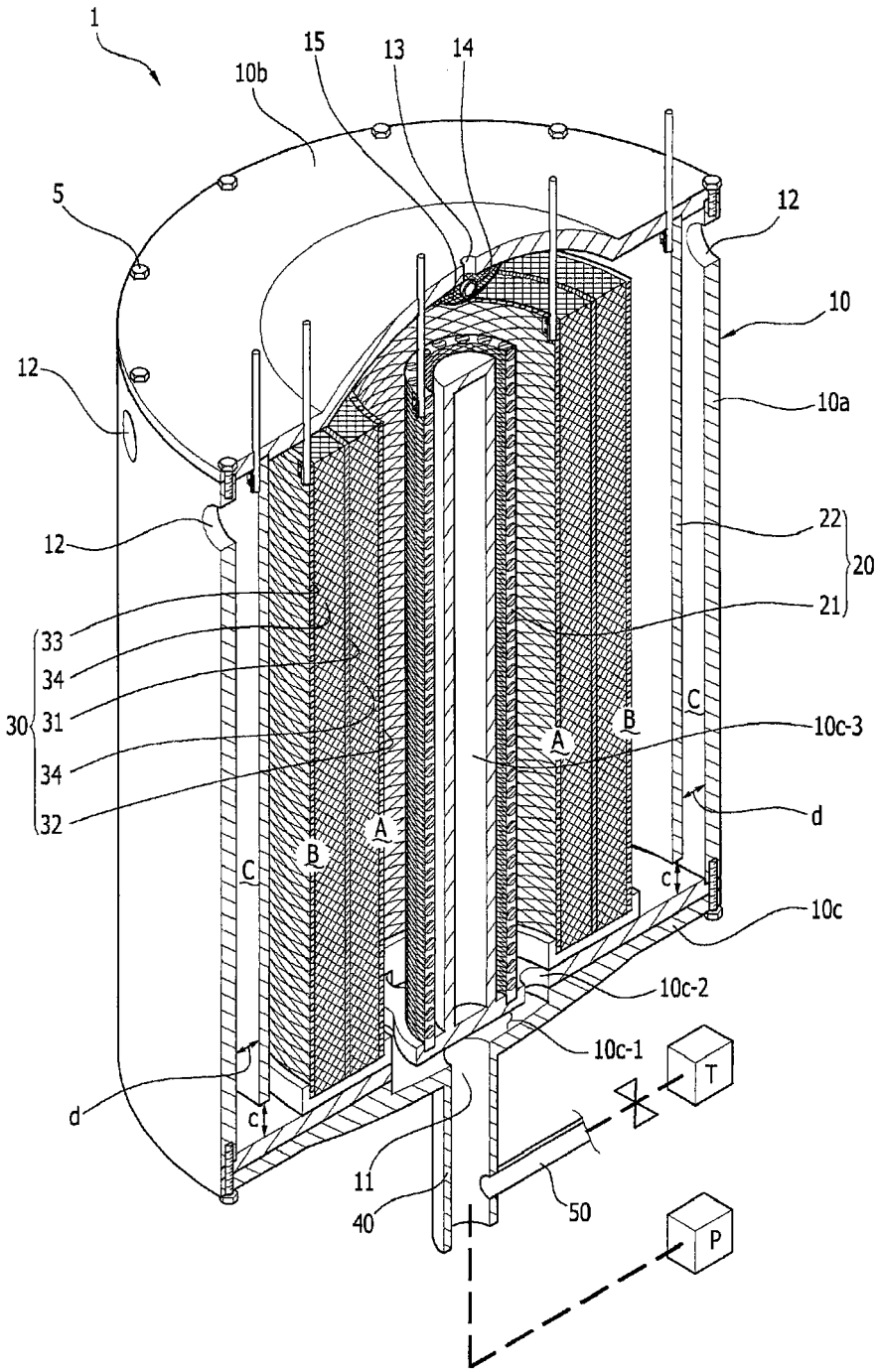
FIG. 3 is a partly perspective and sectional view showing schematically an electrolytic bath for recovering valuable metals in which the contact specific surface area is increased according to the present invention.

FIG. 3 is a partly perspective and sectional view showing schematically an electrolytic bath for recovering valuable metals in which the contact specific surface area is increased according to the present invention. FIG. 4 is a sectional view showing schematically an electrolytic bath for recovering valuable metals in which the contact specific surface area is increased according to the present invention. FIG. 5 is a view showing an embodiment of cathode wire thread applied to an electrolytic bath for recovering valuable metals in which the contact specific surface area is increased according to the present invention.

First, referring to an embodiment of the present invention as shown, housing 10 is formed as a cylinder having an internal space and anode group 20 and cathode group 30 have the same shape as housing 10 in order to surround an internal space of housing 10, however, they are not limited to this configuration, and it has to be understood that shapes of the anode group and cathode group can be varied to rectangular shape or multi-rectangular shape without departing from the scope of the present invention depending on the shape of housing 10.

Figure 4:
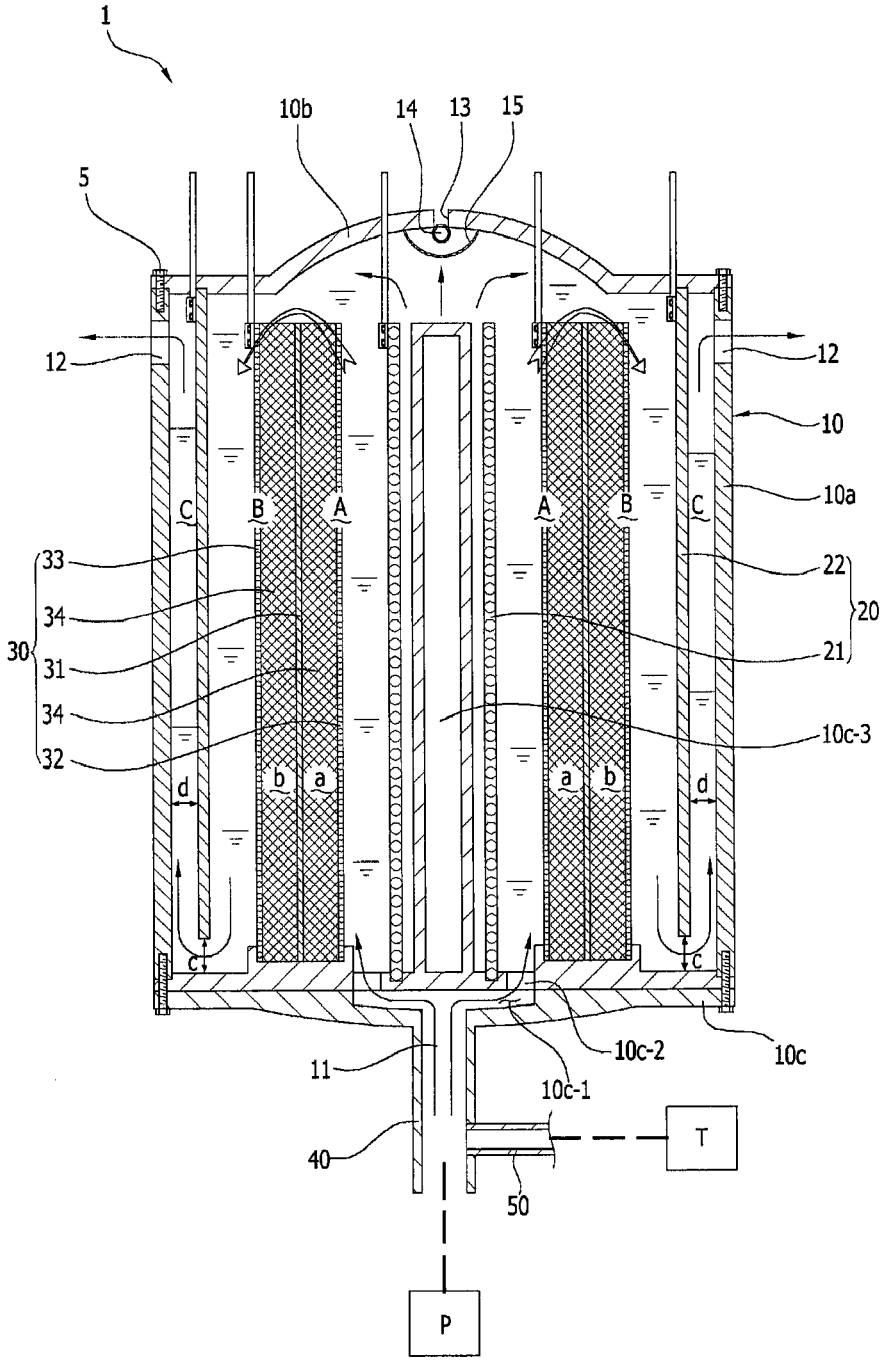
FIG. 4 is a sectional view showing schematically an electrolytic bath for recovering valuable metals in which the contact specific surface area is increased according to the present invention.
Figure 5A:
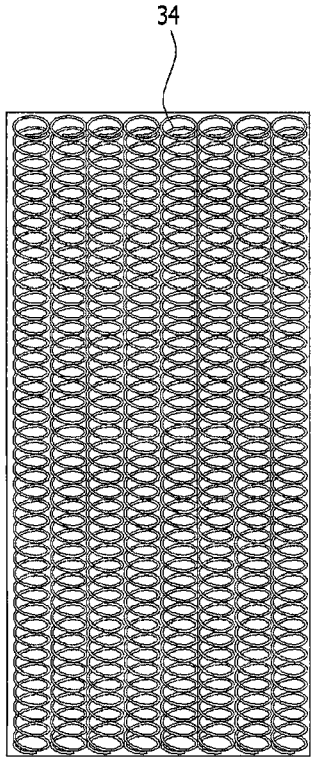
FIG. 5 is a view showing an embodiment of the cathode wire thread applied to an electrolytic bath for recovering valuable metals in which the contact specific surface area is increased according to the present invention.
Figure 5B:
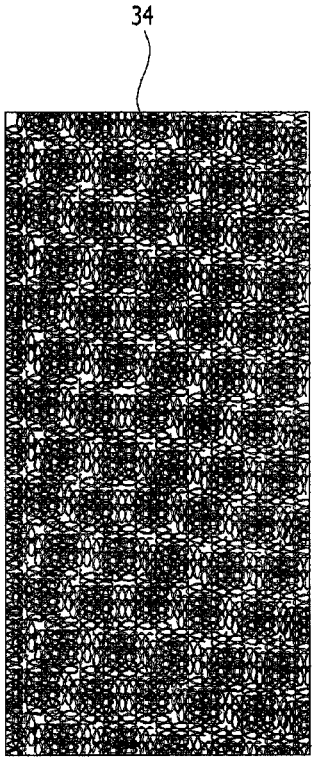

As shown in FIGS. 3-5, electrolytic bath 1 for recovering valuable metals according to the present invention comprises housing 10 of a cylinder shape having an internal space, and anode group 20 and cathode group 30 which are arranged in the internal space of housing 10 and surround the internal space thereof.

Inlet 11 is formed to pass through the bottom surface of housing 10, outlet 12 is formed on an upper part of the side wall of housing 10, and gas discharge hole 13 is formed on the upper surface of housing 10. Preferably, housing 10 comprises a cylindrical external body 10*a* an upper part and lower part of which are open and which has an internal space and is a cylindrical shape and on an upper one side of which outlet 12 is formed through. Lower cap 10*c* is connected to the lower part of external body 10*a* by a connection member 5 such as a screw to form a bottom surface of the housing and on the middle of which inlet 11 is formed through. Upper cap 10*b* is connected to the upper part of external body 10*a* by a connection member 5 such as a screw to form an upper surface of the housing and on one side of which gas discharge hole 13 is formed through. Preferably, outlet 12 formed on one side of external body 10*a* may be formed as plurals such as 6-8, which are arranged in a space. Additionally, gas discharging port 13 may be formed as plurals, if necessary.

Upper cap 10*b* further comprises an avoidance ball fence network 15 having a network configuration, which supports fluid avoidance ball 14 so that free movement of the ball within the internal space of housing 10 can be controlled. In other words, housing 10 further comprises fluid avoidance ball 14 which stops up gas discharge hole 13 depending on the internal pressure during the electrolysis process so that gas can be moved, that is, discharged freely, but the waste water within the internal space is not leaked. Gas discharge hole 14 is formed to pass through the middle part of upper cap 10*b* of housing 10 and avoidance ball fence network 15 having a network configuration is provided on an internal side of upper cap 10*b*, which supports fluid avoidance ball 14 so that free movement of fluid can be controlled within the internal space of housing 10. Through this avoidance ball fence network 15 fluid avoidance ball 14 is placed near gas discharge hole 13 and stops up gas discharge hole 13 depending on the internal pressure, preventing the waste water from being leaked.

Lower cap 10*c* of housing 10 is configured such that the waste water is inputted first into first electrolysis space A formed by internal anode 21 of anode group 20 and middle cathode 31 of cathode group 30, which is placed on the middle part of housing 10, as shown in FIGS. 3 and 4, so that the waste water inputted through inlet 11 passes through in sequence an electrolysis space for valuable metals to be deposited. Preferably, lower cap 10*c* may further comprise input path 10*c*-1 communicated to inlet 11, and a plurality of input path port 10*c*-2 which are communicated to input path 10*c*-1 and inputs the waste water into the internal space of the housing. As a result, the waste water inputted through inlet 11 is inputted to first electrolysis space A through the plurality of input path ports 10*c*-2 and valuable metals are recovered.

Furthermore, the lower cap 10*c* may comprise, if necessary, flow guide bar 10*c*-3 which protrudes upward and thus is placed on the internal part of internal electrode 21. Flow guide bar 10*c*-3 guides a flow of the waste water inputted into inlet 11 to an electrolysis space formed by anode group 20 and cathode group 30, improving an electrolysis efficiency and increasing the recovery rate of valuable metals.

In other words, as shown in FIGS. 3-4, internal electrode 21 of anode group 20 has a network configuration having an internal space. Flow guide bar 10*c*-3 is placed inside of internal electrode 21, is formed as an internal sealed-bar shape, and forms a flow path for guiding the inputted waste water to the electrolysis space side.

Meanwhile, inlet 11 formed on lower cap 10*c* of housing 10 is connected, preferably to external input tube path 40 through which the waste water is transferred from outside and further external pump P may be provided on one side of external input tube path 40 for compulsively inputting the waste water into housing 10.

As for the anodes and cathodes of anode group 20 and cathode group 30 used in the electrolytic bath 1 for recovering valuable metals according to the present invention, unplated Ti material is used. Here, in order to avoid a state that electric conductivity within the electrolytic bath 1 is not properly maintained depending on the properties of the input waste water and the properties of titanium, additions input tube path 50 for compulsively injecting current density additions to increase the current density may further be provided on one side of external input tube path 40.

Of course, material with a surface coated with metals having high current density may be used for anode group 20 and cathode group 30 depending on the properties of the input waste water. At this time, a control valve (not shown) may be further provided on input tube path 50, if necessary, and the amount and the velocity of injection of the current density additions can be controlled manually or automatically by the control valve.

Referring to one embodiment of electrolytic bath 1 for recovering valuable metals in which the contact specific surface area is increased, the valuable metals contained in waste water are electrically deposited and recovered on cathode group 30 depending on a development of an electrolysis process, and preferable the cathode group comprises: middle cathode 31 which divides the space between adjoining anodes into two parts, surrounds the internal space of the housing 10, is shaped as a cylinder and has a plate configuration; first cathode 32 which is placed inside and spaced from middle cathode 31, is a cylinder shape and has a network configuration; and second cathode 33 which is placed outside and spaced from middle cathode 31, is a cylinder shape and has a network configuration. Meanwhile, a quantity of cathode wire thread 34 is disposed to fill interval space a formed by first cathode 32 and middle cathode 31 and interval space b formed by second cathode 33 and middle cathode 31. Preferably the bottom surface of cathode group 30, that is, the lower surface of interval spaces a and b is blocked by a network structure or plate structure so that cathode wire thread 34 disposed within the interval spaces a and b is not separated therefrom.

Meanwhile, cathode wire thread 34, as shown in FIG. 5(*a*) is formed as a coil spring form and a plurality thereof are arranged closely within interval spaces a and b, causing the specific surface area contacting the waste water to be maximized. In addition, cathode wire thread 34, as shown in FIG. 5(*b*), may be formed as a dish sponge by being clustered with adjoining cathode wire thread 34 in order to increase the specific surface. In other words, the cathode wire thread 34 may be filled inside the interval spaces a and b as a coil spring form or dish sponge form by being clustered with adjoining cathode wire thread 34 in order to be adhered and detached easily and increase the specific surface.

Cathode group 30 is adhered by its lower part being adhered and fixed to a seating groove formed on the bottom surface of housing 10, that is, the inner side of lower cap 10*c*, and the waste water flowing into an upper part of middle cathode 31 passes over middle cathode 31. Cathode group 30 seated within the seating groove is adhered and detached easily, and preferably the bottom surface thereof is blocked to prevent separation of cathode wire thread 34.

In one embodiment of the present invention, anode group 20 comprises internal anode 21 formed as a cylinder form of network configuration and placed on the middle part of the internal space of housing 10 and external anode 22 having a cylinder form of a plate configuration which is placed a distance d from the inner side wall of housing 10. Internal anode 21 is seated and fixed in a seating groove formed on the bottom surface, that is, the inner side surface of lower cap 10*c*, and external anode 22 is fixed to the upper surface of housing 10, that is, to one side of upper cap 10*a*, which is spaced from the inner side wall of housing 10, that is, the inner side wall of external body 10*a*, forming a waste water output path distance c.

Waste water output path distance c is communicated to a space formed by distance d between external anode 22 and the inner side wall of housing 10, and distance d as waste water output path C is communicated to a plurality of outlets 12 on an upper side of external body 10*a*. Preferably, the bottom surface of housing 10 corresponds to the inner side surface of lower cap 10*c* and the upper surface of housing 10 corresponds to the inner side surface of upper cap 10*b*.

As described previously, anode group 20 comprises internal anode 21 and external anode 22, and cathode group 30 is placed within the space formed by internal anode 21 and external anode 22, and middle cathode 31 of cathode group 30 forms first electrolysis space A together with internal anode 21 and forms second electrolysis space B together with external anode 22. Further, cathode wire thread 34 of cathode group 30 fills spaces a and b on one side of first and second electrolysis spaces A and B by first and second cathode 32 and 33 of cathode group 30.

Additionally, first electrolysis space A and second electrolysis space B are connected with an 'S' shape flow path. The waste water inputted through inlet 11 passes through the first and second electrolysis space A and B and after valuable metals are deposited on the cathode group 30 and recovered, the waste water passes outside through outlet 12.

As described previously, electrolytic bath 1 for recovering valuable metals in which a contact specific surface area is increased according to the present invention is configured such that a quantity of wire thread 34 fills spaces a and b between cathodes of a network configuration or a plate configuration, causing the contact specific surface area to be increased. Cathode group 30 is placed between the anodes of anode group 20 and thus divides the electrolysis space into a plural through which an electrolysis process is to be performed at several times, causing the recovery rate of the valuable metals to be increased.

Again, referring to FIGS. 3-5, valuable metals recovery process, that is, electrolysis process using electrolytic bath 1 for recovering valuable metals in which contact specific surface area is increased according to the present invention will be described as following.

First, waste water containing valuable metals is inputted into an inner space of housing 10 through input tube path 40 with a pumping power provided by external pump P. At this time, the waste water passes through inlet 11 of lower cap 10*c* and is inputted into an input path 10*c*-1 and then passes through input path port 10*c*-2 with the pump pressure and is inputted into an internal space of housing 10. Here, preferably, the waste water is inputted into first electrolysis space A, that is, the space formed by internal anode 21 of anode group 20 and the inner side wall of middle cathode 31 of cathode group 30. After that, the waste water having passed through first electrolysis space A flows over an upper part of middle cathode 31 of cathode group 30 and then is moved to second electrolysis space B formed by external anode 22 of anode group 20 and the external surface of middle cathode 31 of cathode group 30.

Meanwhile, a quantity of cathode wire thread 34 fills one side of each of first and second electrolysis spaces A and B, that is, space a formed by first cathode 32 and middle cathode 31 of cathode group 30, and space b formed by second cathode 33 and middle cathode 31. First and second cathodes 32 and 33 are each configured as a network, and the waste water passes through the network configuration to contact the surface of the cathode wire thread.

When electric power is supplied to an electrode tip protruded outside from the housing, current moves through anode group 20 and cathode group 30 and the valuable metals within the waste water are deposited and recovered by an electrolysis process on cathode group 30, in more detail, the quantity of cathode wire thread 34 which has the maximum specific surface area.

Here, the waste water containing valuable metals passes through an 'S' shaped flow path and is electrolyzed. The waste water is inputted through inlet 11 and passes through first electrolysis space A, flows over middle cathode 31 and enters second electrolysis space B.

In addition, the waste water containing valuable metals passes through lower waste water output path distance c of external anode 22 and then is discharged outside through waste water output path C formed by external anode 22 and an inner side wall distance d of external body 10*a* of housing 10 and through a plurality of outlets 12 placed on an upper side thereof.

Meanwhile, when the waste water is inputted into housing 10 through inlet 11, the waste water moves with an upward flow velocity caused from its internal pressure and thus the waste water is prevented from leaking into gas discharge hole 13 by fluid avoidance ball 14 and passes safely through the electrolysis space. Additionally, gas produced during an electrolysis process is discharged outside through gas discharge hole 13, causing the electrolytic bath to be safe, and remaining gas is discharged outside through gas outlet 12, together with waste water.

Finally, predetermined amount of current density additions is inputted into the housing by an adjustment of a control valve (not shown) on addition input tube path 50 and electric conductivity is controlled, causing the recovery rate of valuable metals to be increased.

The electrolytic bath for recovering valuable metals in which a contact specific surface area is increased according to the present invention has following effects:

First, through the cathode group comprising the first cathode, the middle cathode and the second electrode and having the cathode wire thread filled therebetween, the contact specific surface area of the waste water inputted into the electrolytic bath is increased and thus even in case of the waste water containing minute amount of valuable metals, the valuable metals can be deposited and recovered easily.

Second, the cathode group is placed between the internal anode and the external anode to form a plurality of electrolysis spaces and thus the waste water passes through the electrolysis spaces in sequence and the valuable metals are deposited, causing an electrolysis efficiency to be increased.

Thirdly, through the gas discharge hole formed on one side of the housing, gas produced during an electrolysis process is discharged first, improving the safety of the electrolytic bath. The fluid avoidance ball blocks and controls the gas discharge hole depending on the internal pressure, if necessary, to prevent leakage of the waste water.

Fourth, through the avoidance ball fence network for supporting the fluid avoidance ball, the safety of the structure can be maintained.

Fifth, through the current density additions inputted, if necessary, the cathode group and the anode group maintain a high electric conductivity depending on the waste water of acidity, neutrality and alkalinity property, causing the valuable metal recovery rate to be increased.

Sixth, through cylinder shapes of the housing, the cathode group and the anode group surrounding the inner side of the housing, the specific surface area inputted through the inlet on the lower middle thereof, with which the waste water is contacted is maximized and the waste water passes through electrolysis space with rolling inside the housing, causing a recovery rate of the valuable metals to be increased.

While the present invention is described referring to the preferred embodiment, the present invention is not limited thereto, and thus various variation and modification can be made without departing from a scope of the present invention.

What is claimed is:

1. An electrolytic bath containing waste water and using an electrolysis process for recovering valuable metals with increased contact specific surface area for depositing electrically and recovering valuable metals comprising:

a housing including a cylinder shape and an internal space, on a first side of which an inlet is formed and on a second side of which an outlet and a gas discharge hole are formed;

an anode group consisting of a plurality of anodes arranged to surround the inside of the housing; and a cathode group surrounding the inside of the housing, which is arranged between the anodes and divides a space adjoining the anodes into two electrolysis spaces in which a quantity of cathode wire thread is placed on one side of the respective electrolysis spaces and a specific surface area with which waste water contact is increased wherein the waste water inputted through the inlet passes through in sequence the electrolysis spaces, valuable metals are deposited electrically and recovered on the cathode group including the quantity of cathode wire thread, gas is discharged through the gas discharge hole, and the waste water is discharged outside through the outlet, the cathode group including:

(a) a middle cathode which surrounds the internal space of the housing, is shaped as a cylinder and has a solid configuration, (b) a first cathode which is placed inside and spaced from the middle cathode, is a cylinder shape and has a network configuration, (c) a second cathode which is placed outside and spaced from the middle cathode, is a cylinder shape and has a network configuration, and (d) wherein the quantity of cathode wire thread fills a first interval space formed by the first cathode and the middle cathode and a second interval space formed by the second cathode and the middle cathode.

2. The electrolytic bath according to claim 1, wherein a cathode of the cathode group and an anode of the anode group are made of unplated titanium material.

3. The electrolytic bath according to claim 1, wherein the cathode wire thread is a coil spring shape and a plurality of the cathode wire threads are arranged closely.

4. The electrolytic bath according to claim 1, wherein the cathode wire thread is clustered to an adjoining cathode wire thread to form a mesh configuration.

5. The electrolytic bath according to claim 1, wherein a lower end of the cathode group is seated in a bottom surface of the housing, and the waste water flows over an upper part of the middle cathode and is transferred to an adjoining electrolysis space.

6. The electrolytic bath according to claim 1, wherein the anode group comprises an internal anode which is formed as a cylinder shape of a network configuration, and is placed on a central part of the internal space of the housing, and an external anode which is formed as a cylinder shape of a solid configuration and is placed adjacent to an inner side wall of the housing, and forms a waste water output path communicated to the outlet wherein the internal anode is seated and fixed to a bottom surface of the housing, and the external anode is fixed to an upper surface of the housing to form a downward waste water output path.

7. The electrolytic bath according to claim 6, wherein the housing includes the inlet passed through the bottom surface thereof, the outlet on an upper part of the inner side wall, and the gas discharge hole on the upper surface thereof, and further the internal anode and the middle cathode form a first electrolysis space and the external anode and the middle cathode form a second electrolysis space which is connected to the first electrolysis space through an 'S' shaped flow path, wherein the waste water inputted through the inlet passes through the first electrolysis space and the second electrolysis space in sequence and is discharged through the outlet.

8. The electrolytic bath according to claim 7, further including a fluid avoidance ball which is configured to block the gas discharge hole depending on internal pressure so that gas is moved freely and leaking of waste water is avoided.

9. The electrolytic bath according to claim 7, wherein the housing comprises a cylindrical external body the upper part and lower part of which are opened and on an upper one side of which a plurality of the outlets are formed, a lower cap which is connected to the lower part of the cylindrical external body to form the bottom surface of the housing and on the middle of which the inlet is formed, and an upper cap which is connected to the upper part of the cylindrical external body to form the upper surface of the housing and on one side of which the gas discharge hole is formed.

10. The electrolytic bath according to claim 9, wherein the lower cap may further comprise an input path communicated to the inlet, and a plurality of input path ports which are communicated to the input path and inputs the waste water into the first electrolysis space formed between the internal anode and the middle cathode.

11. The electrolytic bath according to claim 10, wherein the lower cap comprises a flow guide bar which protrudes upwardly and is placed on an internal part of the internal anode.

12. The electrolytic bath according claim 9, wherein the inlet is connected to an external input tube path through which the waste water is transferred from an external place and an external pump is provided on one side of the external input tube path for inputting compulsively the waste water into the housing.

13. The electrolytic bath according to claim 12, wherein an addition input tube path for compulsively inputting a current density addition to increase electric conductivity is provided on one side of the external input tube path, and the addition input tube path is controlled by a control valve.

14. The electrolytic bath according to claim 9, wherein the housing further comprises a fluid avoidance ball which is configured to stop up the gas discharge hole depending on a pressure of the internal space of the housing so that gas is moved freely and leakage of waste water is avoided, and the upper cap further comprises a avoidance ball fence network having a network configuration, which supports the fluid avoidance ball and controls a free movement of the ball within the internal space of the housing.

15. The electrolytic bath according to claim 7, wherein the inlet is connected to an external input tube path through which the waste water is transferred from an external place and an external pump is provided on one side of the external input tube path for inputting compulsively the waste water into the housing.

16. The electrolytic bath according to claim 15, wherein an addition input tube path for compulsively inputting a current density addition to increase electric conductivity is provided on one side of the external input tube path, and the addition input tube path is controlled by a control valve.

* * * * *